US010173222B2

(12) United States Patent
Simons et al.

(10) Patent No.: US 10,173,222 B2
(45) Date of Patent: Jan. 8, 2019

(54) AGITATOR BALL MILL

(71) Applicant: Willy A. Bachofen AG, Muttenz (CH)

(72) Inventors: Benedikt Simons, Schopfheim (DE); Lionel Gross, Rouffach (FR); Norbert Stehr, Grünstadt (DE)

(73) Assignee: Willy A. Bachofen AG, Muttenz (CH)

( * ) Notice: Subject to any disclaimer, the term of this patent is extended or adjusted under 35 U.S.C. 154(b) by 29 days.

(21) Appl. No.: 15/783,304

(22) Filed: Oct. 13, 2017

(65) Prior Publication Data

US 2018/0104698 A1 Apr. 19, 2018

(30) Foreign Application Priority Data

Oct. 18, 2016 (EP) ..... 16194368

(51) Int. Cl.
*B02C 17/00* (2006.01)
*B02C 17/16* (2006.01)
*B02C 17/18* (2006.01)

(52) U.S. Cl.
CPC ..... *B02C 17/163* (2013.01); *B02C 17/16* (2013.01); *B02C 17/161* (2013.01); *B02C 17/1855* (2013.01); *B02C 2017/165* (2013.01)

(58) Field of Classification Search
CPC . B02C 17/163; B02C 17/1855; B02C 17/161; B02C 2017/165
USPC ..... 241/171–172
See application file for complete search history.

(56) References Cited

U.S. PATENT DOCUMENTS 2,235,985 A 3/1941 Dibble
5,566,896 A * 10/1996 Stehr ..... B02C 17/16 241/171
5,624,080 A * 4/1997 Stehr ..... B02C 17/161 241/171
5,769,338 A * 6/1998 Yashima ..... B02C 17/16 241/172
5,797,550 A * 8/1998 Woodall ..... B02C 17/16 241/171
5,984,213 A * 11/1999 Woodall ..... B02C 17/16 241/171

(Continued)

FOREIGN PATENT DOCUMENTS

DE 1632424 A1 8/1970
EP 0751830 A1 1/1997

(Continued)

OTHER PUBLICATIONS

Search Report for European Patent Application No. 16194368.3, dated Jan. 19, 2017.

*Primary Examiner* — Faye Francis
(74) *Attorney, Agent, or Firm* — Merchant & Gould P.C.

(57) ABSTRACT

An agitator ball mill that includes agitating discs (18) on an agitating shaft drivable in a spinning direction (38), which are provided with entraining profiles (35). These entraining profiles (35) are formed by a trailing wall of a respective channel of a plurality of channels (36). In relation to the spinning direction (38) the trailing wall (39) of an inner channel section (49) runs radially straight relative to the central longitudinal axis (15) and has a length f, and has an outer bent-off channel section (41), which is bent off counter to the spinning direction (38). The outer channel sections (41) are closed radially to the outside by a peripheral portion (42) of the agitating disc (18) having a radial width e.

15 Claims, 7 Drawing Sheets

(56) References Cited

U.S. PATENT DOCUMENTS

Figure 1:
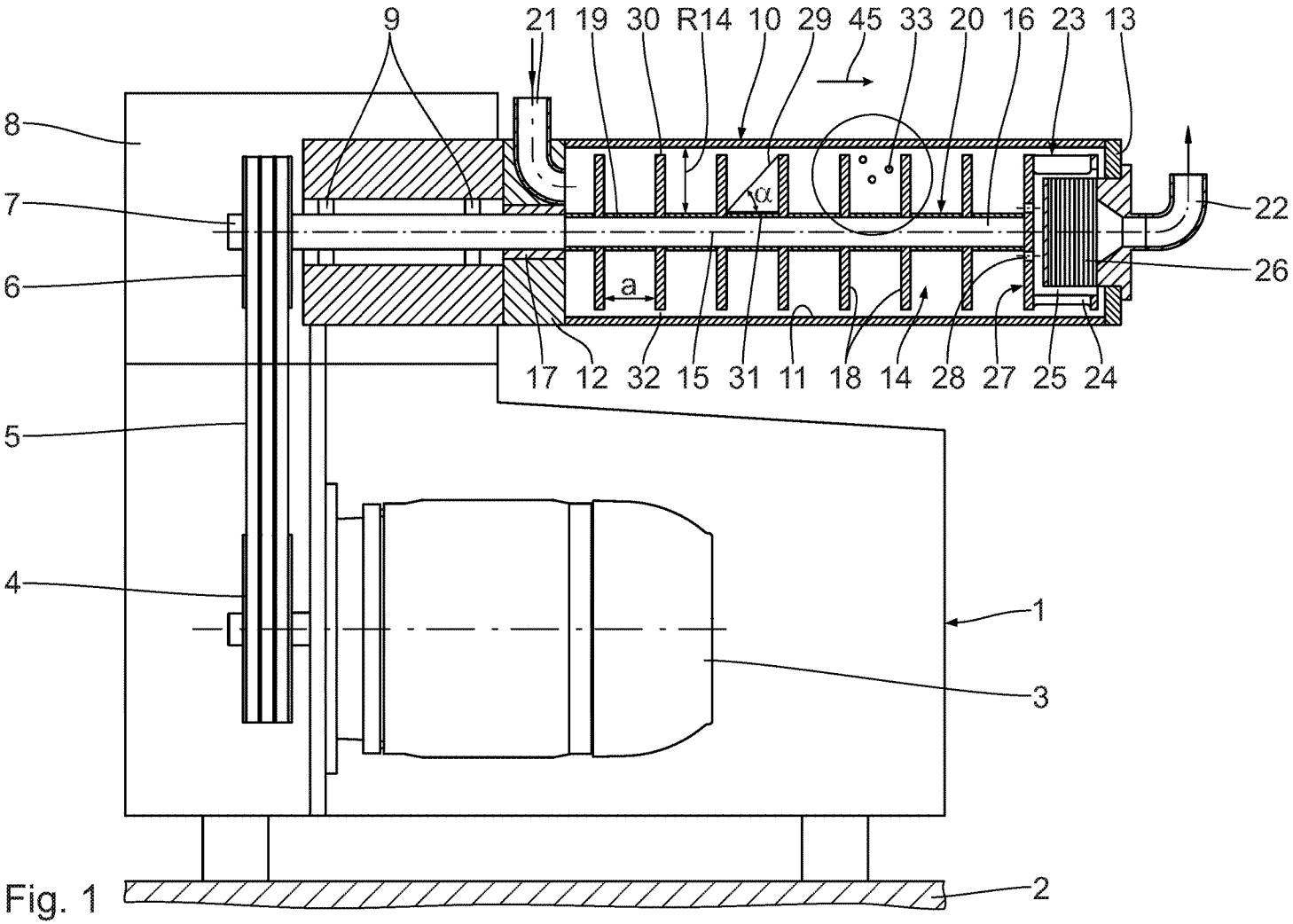

| | | | | |
|---|---|---|---|---|
| 7,014,134 | B2 * | 3/2006 | Heinzelmann | B02C 17/161<br>241/171 |
| 8,002,213 | B2 * | 8/2011 | Stehr | B02C 17/163<br>241/171 |
| 8,794,558 | B2 * | 8/2014 | Pausch | B02C 17/16<br>241/171 |
| 8,814,071 | B2 * | 8/2014 | Jeker | B02C 17/163<br>241/171 |
| 2009/0212141 | A1 * | 8/2009 | Taylor | B01F 7/00766<br>241/22 |
| 2011/0036935 | A1 | 2/2011 | Stehr | |

FOREIGN PATENT DOCUMENTS

| | | | |
|---|---|---|---|
| EP | 2178642 | A1 | 4/2010 |
| EP | 3050628 | A1 | 8/2016 |
| GB | 302152 | A | 4/1929 |
| GB | 1197523 | A | 7/1970 |
| WO | 2009/024158 | A1 | 2/2009 |

* cited by examiner

AGITATOR BALL MILL

This application claims benefit of Ser. No. 16/194,368.3, filed on 18 Oct. 2016 in the European Patent Office and which application is incorporated herein by reference. To the extent appropriate, a claim of priority is made to the above disclosed application.

The invention relates to an agitator ball mill according to the preamble of claim 1 and an agitating disc for an agitator ball mill according to the preamble of claim 13.

In an agitator ball mill known from DE 1 632 424 having a horizontally arranged grinding chamber, agitating discs having circular-shaped entraining profiles are known, which may be formed by openings or slots or by flat grooves. The entraining profiles are circularly shaped and have a radius of curvature which is 50% to 100% of the radius of the disc. Starting from the edge of the disc, the angle of incidence increases by 30% to 50% in the direction towards the center of the disc. Thereby it is to be achieved that the efficiency of dispersion is substantially increased without destruction of grinding bodies. Due to the large radius of curvature, the correspondingly shaped entraining profiles interiorly end at a substantial radial distance from the agitating shaft, and in fact laterally thereof. At the radial inner end, the entraining profiles essentially run tangential to the central longitudinal axis of the agitating shaft, and thus to the torque vector. Overall, the entrainment of the grinding bodies in the inner portion of the agitating disc, corresponding to a radial extension of 50% between the inner and the peripheral boundary of the agitating disc surface located within the grinding chamber, is not satisfactory. An agitator ball mill provided with such agitating discs is only suitable for a comparatively small degree of filling of the grinding chamber with grinding bodies of 40 to 60%, relative to the volume of the grinding chamber. In the periphery of the agitating disc, the grinding bodies are moved radially outwards and perpendicular to the agitating shaft in the plane of the agitating disc by the trailing walls of the entraining profiles. Only a low efficiency can be realized in such an agitator ball mill which, in addition, is non-uniformly distributed over the grinding chamber. Thus, a poor yield regarding space and time consumption can be achieved for such grinding process, at relatively high specific demand for energy.

It is therefore an objection of the invention to achieve a higher efficiency of the grinding process at lower circumferential speed of the agitating discs, and in addition an improved energy efficiency of the grinding process for the production of a narrower particle size distribution of the processed grinding material, as well as a higher productivity.

This object is achieved by the features of independent claim 1 as regards an agitator ball mill, and by the features of independent claim 13 as regards an agitating disc. The fundamental solution approach of the invention is, for the formation of particularly pronounced circular flows in the grinding cells for the more effective entrainment of the grinding bodies, in particular also at high degrees of filling with grinding bodies, to form the accelerating trailing walls of the entraining profiles that already start at the agitating shaft at right angle to the central longitudinal axis in the inner portion thereof and—farther outwards—in a manner bent backwardly, and to not continue the entraining profiles to the disc periphery, i.e. to the outer edge of the agitating disc. Surprisingly, it has turned out that the grinding quality increases in terms of a narrower particle distribution within the processed grinding material in case the entraining profiles end before reaching the outer edge of the agitating disc, at comparable conditions of otherwise conventional agitator ball mills. One explanation therefor is that the grinding bodies which are accelerated outwards by the entraining profiles in their radially outer portion are redirected to the upstream grinding cell by the front surface of the respective agitating disc and to the downstream grinding cell by rear surface of the respective agitating disc, relative to the overall direction of flow through the agitator ball mill. Thus, the result is a defined fan-out of the outwardly accelerated grinding bodies by both sides of the agitating disc instead of only compressing them in the region between the outer edge of the agitating disc and the wall of the grinding chamber, like in the prior art. No secondary vortices are generated adjacent to the outer edge of the agitating disc, i.e. in the annulus or gap between the outer edge of the agitating disc and the wall of the grinding vessel. This provides for a significantly improved smooth running of the agitator ball mill, combined with a significantly reduced wear of agitating discs and of the walls of the outer grinding cell. Due to the entraining profiles of the agitating discs formed in accordance with the invention those parameters, with which the predefined grinding quality can be achieved, can be set with a drastically reduced specific energy demand for the grinding process. These parameters are in particular a high degree of filling of grinding bodies and at the same time a lower rotational speed of the agitator.

The dependent claims 2 to 12 specify advantageous aspects of the agitator ball mill according to the invention. The aspect of the dependent claims 2 to 6 and 8 to 12 are correspondingly applicable to the agitating disc according to the invention.

Figure 3:
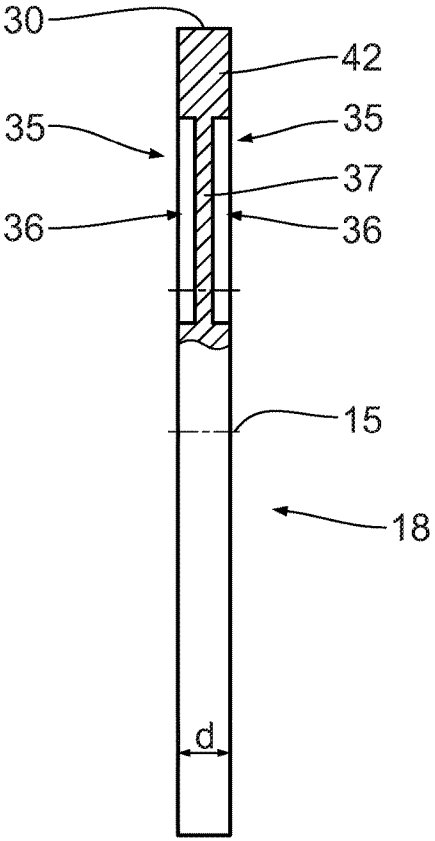
Figure 2:
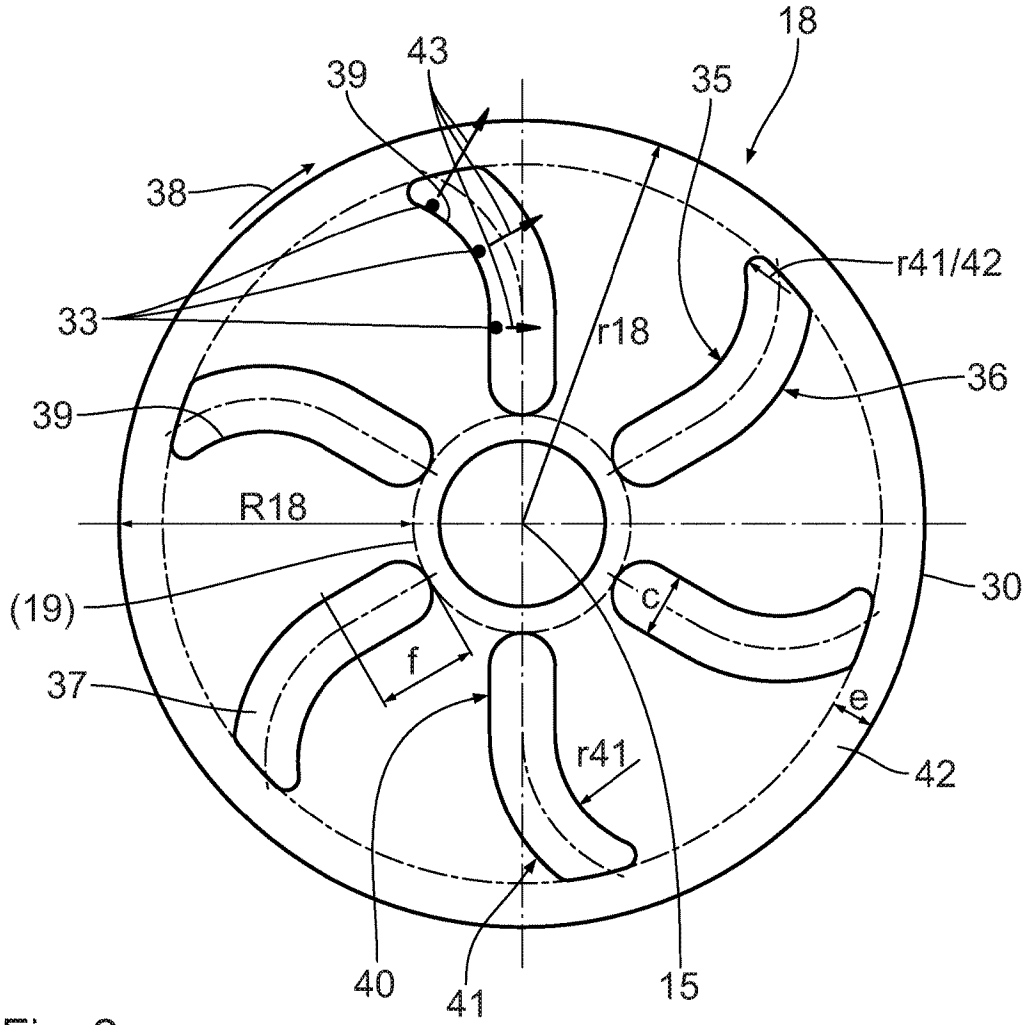
Figure 4:
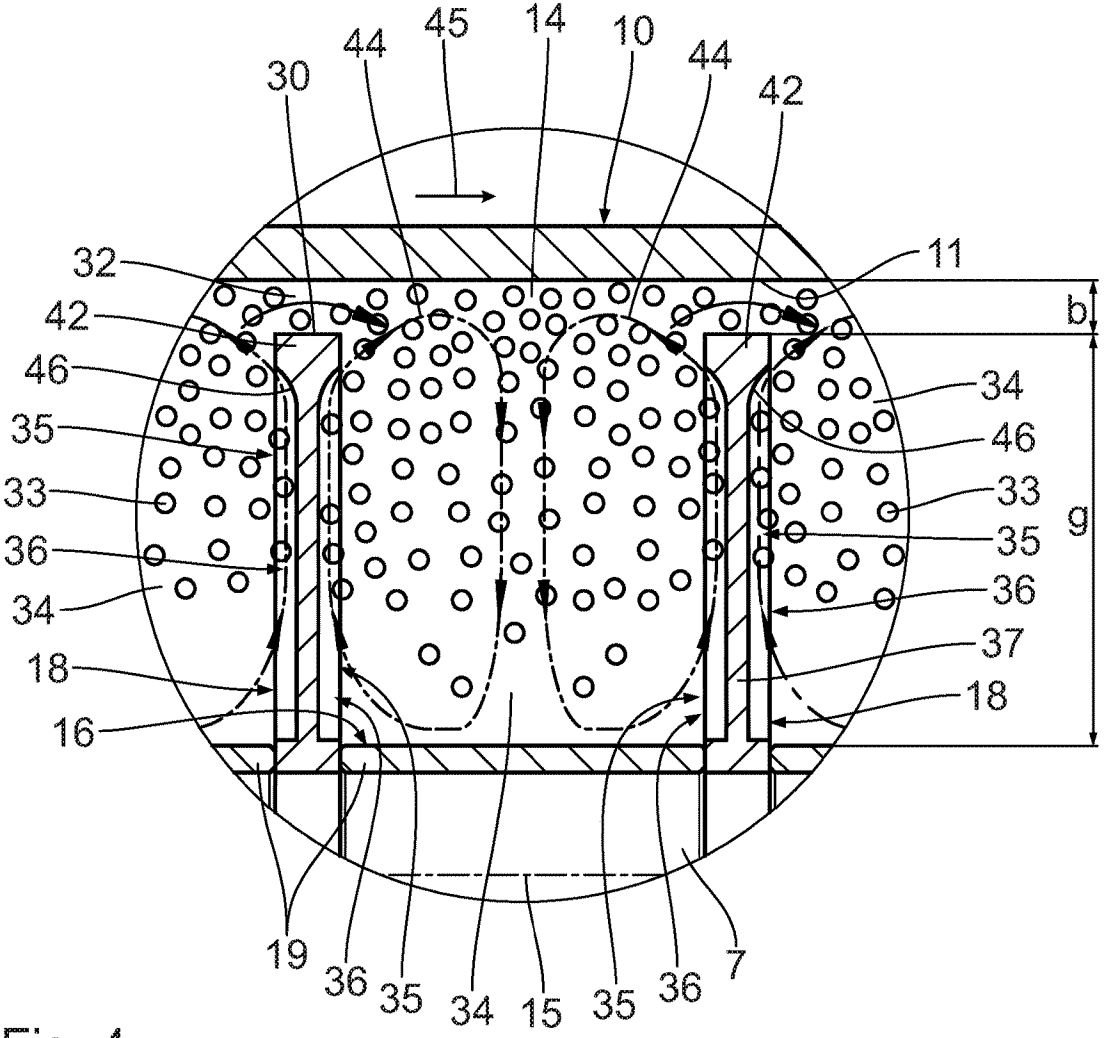
Figure 6:
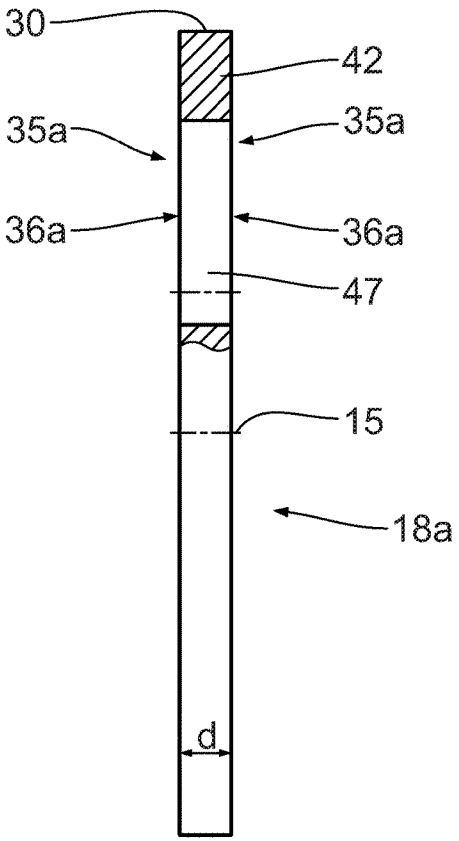
Figure 5:
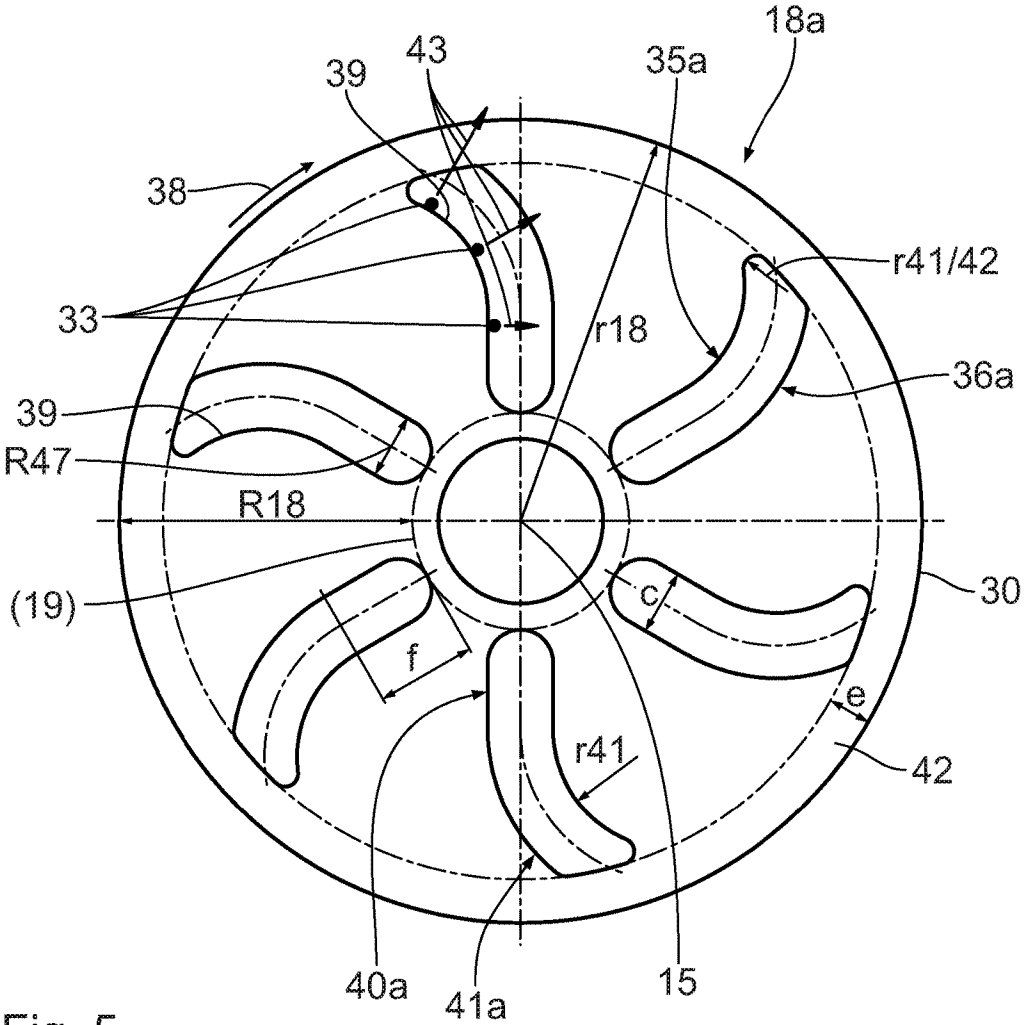
Figure 7:
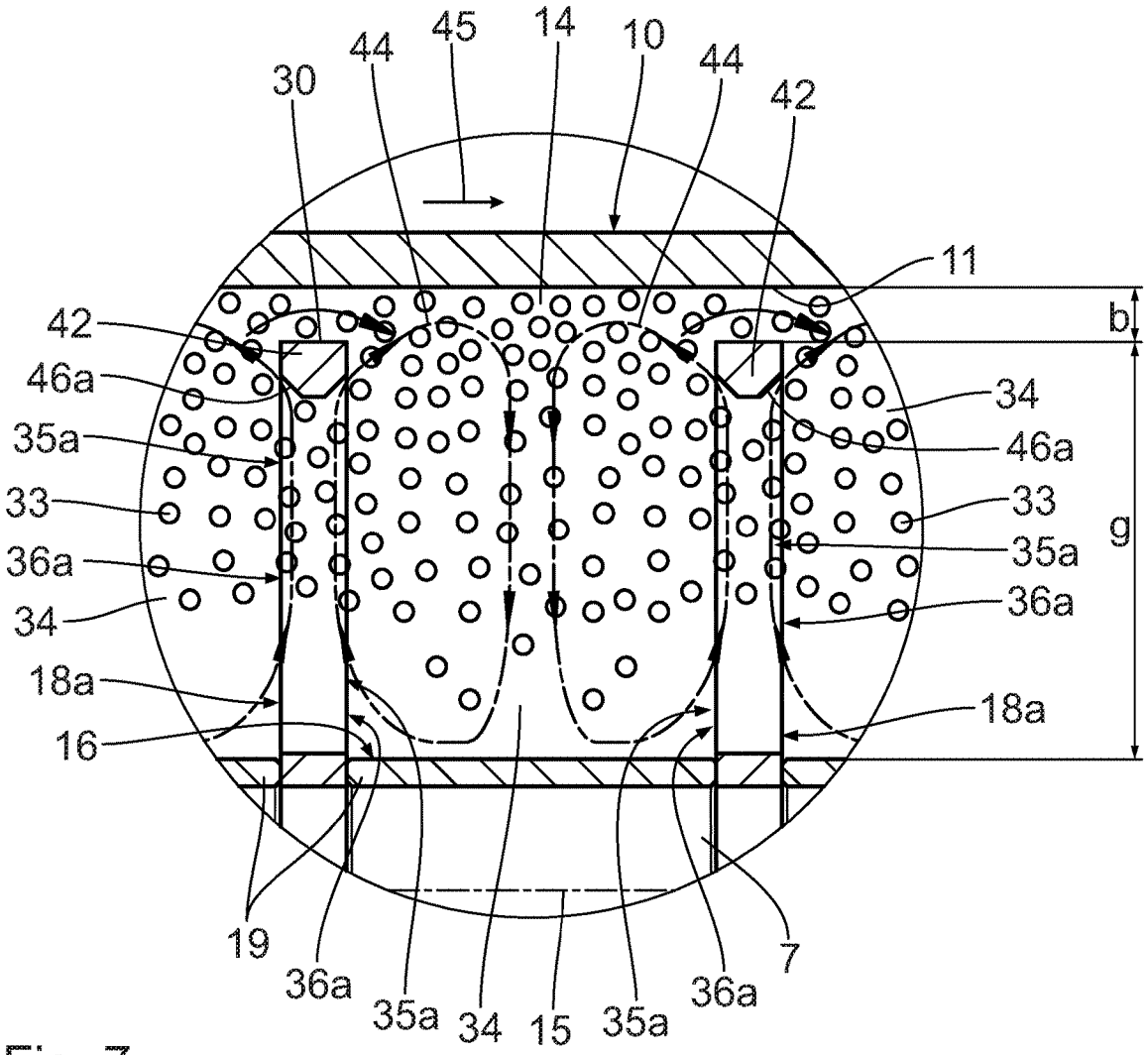
Figure 9:
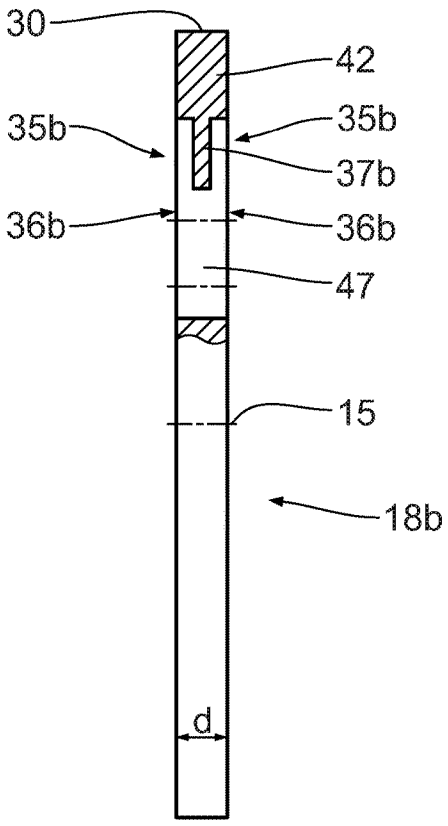
Figure 8:
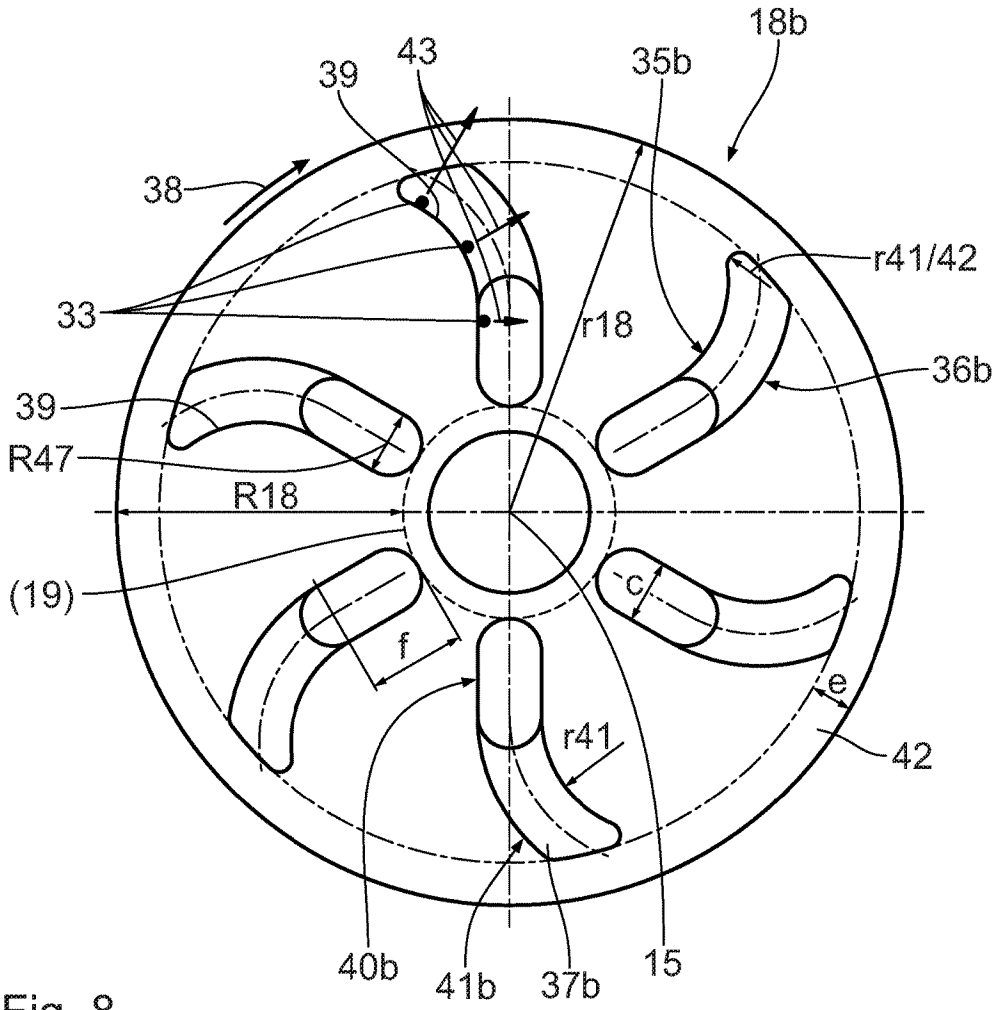
Figure 11:
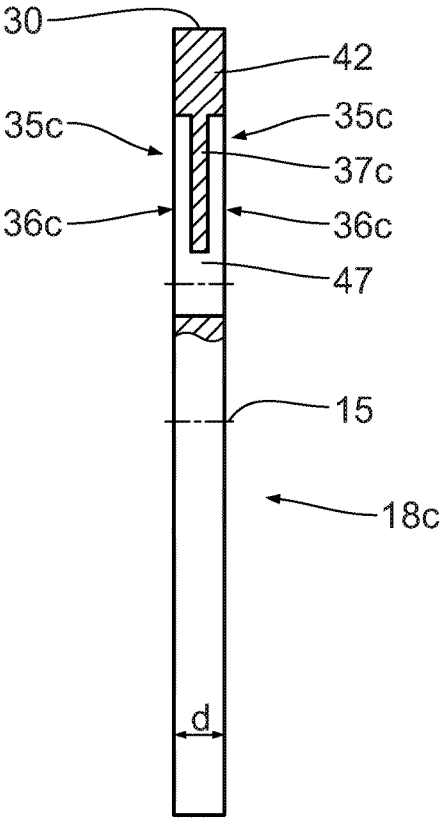
Figure 10:
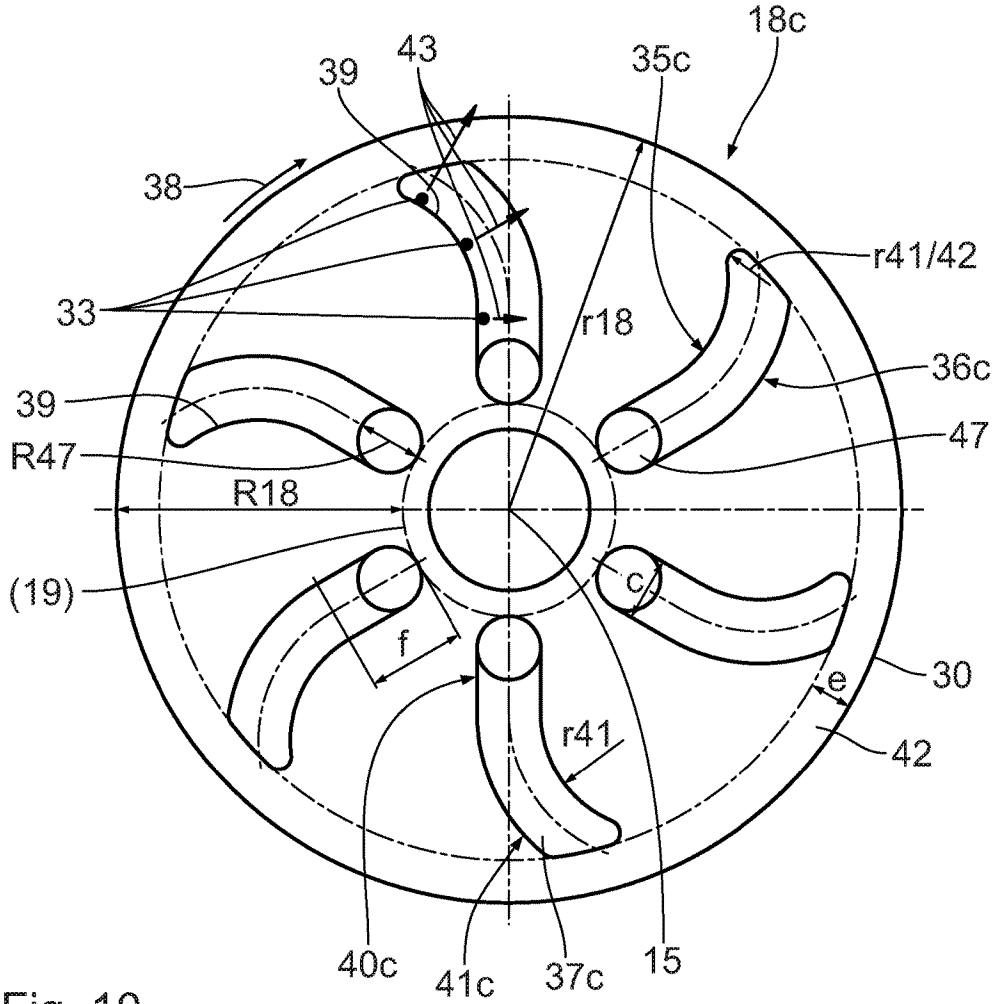

Additional advantages and details of the invention become evident from further dependent claims and from the following description of embodiments of the invention with the aid of the drawings. These show:

FIG. 1 an embodiment of an agitator ball mill according to invention in a schematic representation in a partly sectional side view, FIG. 2 a top view of a first embodiment of an agitating disc according to the invention, FIG. 3 a partial cross-section of the agitating disc according to FIG. 2, FIG. 4 a detail of FIG. 1 in an enlarged scale relative to FIG. 1, with agitating discs according to FIGS. 2 and 3, FIG. 5 a second embodiment of an agitating disc according to the invention in a top view, FIG. 6 a partial cross-section of the agitating disc according to FIG. 5, FIG. 7 a detail of FIG. 1 in an enlarged scale relative to FIG. 1, with agitating discs according to FIGS. 5 and 6, FIG. 8 a third embodiment of an agitating disc according to the invention in a top view, FIG. 9 a partial cross-section of the agitating disc according to FIG. 8, FIG. 10 a fourth embodiment of an agitating disc according to the invention in a top view, and FIG. 11 a partial cross-section of the agitating disc according to FIG. 10.

FIG. 1 shows a horizontal agitator ball mill. It typically comprises a stand 1 that is supported on the ground 2. A drive motor 3 with controllable rotational speed is arranged within the stand 1 and is equipped with a V-belt pulley 4 through which a drive shaft 7 of the agitator ball mill is drivable via a V-belt and a further V-belt pulley 6. In an upper portion of the stand 1 the drive shaft 7 is supported by multiple bearings 9.

An essentially cylindrical grinding vessel 10 is releasably mounted to the upper portion 8 of the stand 1. The cylindrical grinding vessel 10 comprises an inner wall 11 and is closed by a first lid 12 at the end facing the upper portion 8, and is closed by a second lid 13 at the opposite end. The grinding vessel encloses a grinding chamber 14. The inner wall 11 thus forms the grinding chamber outer boundary.

An agitating shaft 16 is arranged concentric to the common central longitudinal axis 15 of the grinding vessel 10 and the drive shaft 7 within the grinding chamber 14 and is connected to the drive shaft 7 in a manner fixed against rotation relative thereto. The grinding chamber 14 is sealed by gaskets 17 between the first lid 12 and the drive shaft 7. The combination of drive shaft 7 and agitating shaft 16 is supported in the manner of a cantilever, and is thus not supported in the region of the second lid 13. The agitating shaft 16 is equipped with agitating tools in the grinding chamber 14 over its entire length, with the agitating tools being embodied as circular agitating discs 18.

The agitating discs 18 are mounted on the agitating shaft 16 and are typically held thereon in a manner fixed against rotation relative thereto, for example by a key and groove connection, and are held axially spaced apart by spacer sleeves 19. The agitating shaft 16 together with the spacer sleeves 19 and the agitating discs 18 form an agitator 20. The spacer sleeves 19 are bounding the generally cylindrical grinding chamber 14 interiorly and thus form a grinding chamber inner boundary.

A grinding material feed 21 is leading in into the grinding chamber 14 in the region of the first lid 12. A grinding material outlet 22 is leading out of second lid 13 at that end of the grinding vessel 10 opposite to the end of the grinding material feed 21.

At the outer circumference of the last agitating disc 18 which is adjacent to the second lid 13, a cylindrical cage 23 is formed. The cage comprises openings 24 distributed over its entire circumference. A screen body 26 that is mounted to the second lied 13 and that is connected to the grinding material outlet 22 is arranged in the separator space 25 bounded by the last agitating disc 18 and the cage 23. These parts form a grinding material/grinding bodies separator unit 27 known from EP 2 178 642 A1, in which grinding material (e.g. grinding suspension) and grinding bodies 33 enter through an opening 28.

Adjacent agitating discs 18 have the same axial distance a from each other. Furthermore, adjacent agitating discs 18 define a separation angle $\alpha$ that is formed by a line 29 between the outer edge 30 of an agitating disc 18 and the base of an adjacent agitating disc 18 on the agitating shaft 16, i.e. on the respective spacer sleeve 19, and by a line 31 parallel to the axis 15. The following condition applies: $30° \leq \alpha \leq 60°$.

The width b of the annular gap 32 between the outer edge 30 and the wall 11 does not exceed 20% of the free Radius R14 of the grinding chamber 14 between its inner boundary and its outer boundary, that is to say: $b \leq 0.2 \cdot R14$.

The grinding chamber 14 is essentially filled with grinding bodies 33, preferably with grinding bodies 33 made of materials having a high density, e.g. high-performance ceramic made of $ZrO_2$ (zirconium dioxide) having a solid density of 6.0 g/cm$^3$. The degree of filling of grinding bodies is within the range of 50% to 90%, particularly within the range of 80% to 90%. The high solid density of the grinding bodies 33 relative to the density of the grinding suspension is important for the desired effects, i.e. to convey the grinding bodies 33 in the area of the surfaces of the respective agitating discs 18 outwards into the zone of accumulated grinding material already at relatively low rotational agitator speeds. Grinding cells 34 (see e.g. FIG. 4) are formed between respective adjacent agitating discs 18.

The agitating discs 18 comprise entraining profiles 35 (see e.g. FIG. 2) for the grinding bodies 33, integrated in the respective agitating disc 18 and thus not projecting from the surface thereof, the profiles immediately starting at the inner wall of the grinding chamber, i.e. at the spacer sleeves 19. For the effects to occur in an optimal manner which are described in the following, the width c of the entraining profiles 35 preferably corresponds to 0.5 to 1.5 times the thickness d of the agitating discs 18 That means: $0.5 \cdot d \leq c \leq 1.5 \cdot d$.

In the embodiment according to FIGS. 2 and 3, the entraining profiles 35 are formed as flat groove-like channels 36, that are formed on both sides of the respective agitating disc 18 in a congruent manner, so that—as can be seen in FIG. 3—a thin wall portion 37 remains between them. The respective channel 36 comprises a trailing wall 39—relative to the spinning direction 38 of the agitating disc 18—that is running parallel to the central longitudinal axis 15, which is also the central longitudinal axis 15 of the respective agitating disc 18. As can be seen in FIG. 2, this channel 36 comprises inner straight channel section 40 that extends outwards at right angle radially to the central longitudinal axis 15, and an outer channel section 41 that is radially outwardly joining the inner channel section 40, that is bent off counter to the spinning direction 38 and that ends at a distance e to the outer edge 30 of the agitating disc 18. The outer channel section 41 therefore ends at a ring-shaped peripheral portion 42 of the agitating disc 18. The distance e or the radial extent e of the enclosing ring-shaped peripheral portion 42 is preferably 0.5 to 1.5 times the thickness d of the agitating discs 18. That means: $0.5 \cdot d \leq e \leq 1.5 \cdot d$.

As can further be seen in FIG. 2, the grinding bodies 33 are entrained tangentially by the—in spinning direction 38—trailing wall 39 and are thereby centrifugally accelerated in the respective channel 36. The tangential speed and therefore the outwardly directed resulting centrifugal accelerations increase radially outwards as it is indicated by the radially outwardly increasing length of the speed arrows 43. Because of the comparatively low tangential speed in the proximity of the agitating shaft 16 or the spacer sleeves 19, respectively, it has shown to be effective in terms of power input into the grinding chamber 14 if the wall 39 that accelerates the grinding bodies 33 to the local circumferential speed is oriented perpendicular to the torque vector. i.e. to the central longitudinal axis 15. This is achieved due to the straight, radially arranged inner channel section 40. A corresponding centrifugal acceleration results from the circumferential speed of the grinding bodies 33

According to the invention the straight inner channel section 40 has a length f that is 25% to 60%, preferably 30% to 50%, of the free radius R18 of the agitating disc 18 from the spacer sleeve 19 to the outer edge 30. That means: $R18 \leq f \leq 0.6 \cdot R18$, and preferably $0.3 \cdot R18 \leq f \leq 0.5 \cdot R18$. It has shown that a radial section 40 of the entraining profile 35 that significantly exceeds 60% of the free radius R18 of the agitating disc 18 leads to unfavorable turbulences of the grinding bodies 33 that cannot be utilized for the grinding process.

Due to the rearwardly, counter to the spinning direction 38 bent channel section 41, and in particular due to its trailing wall 39 acting as entrainment surface, a tangential-radial entrainment of grinding bodies 33 which are in engagement with the wall 39 results from the local circumferential speed, and occurs in addition to the centrifugal acceleration. The grinding bodies are quasi positively transported outwardly.

The radial entraining component advantageously continuously increases outwards. To reach an energetically beneficial grinding process, it has proven to be advantageous for the radius of curvature r41 to be smaller than 40% of the radius r18 of the agitating disc 18. It has to be taken into account that the channel 36 and in particular the channel section 41 at the outer end runs out having its full width c. The trailing wall 39 merges into the outer boundary of the channel section 41 which runs concentrically to the outer edge 30 of the agitating disc 18 and which is formed by the ring-shaped peripheral portion 42 with a very small merging-radius r41/42, i.e. at an acute angle. The merging-radius r41/42 should preferably be smaller than 20% of the width c of the entraining profile 35. That means: r41/42≤0.2·c. The trailing wall 39, embodied in accordance with the invention, thus exerts solely outwardly directed accelerations on the grinding bodies 331 all the way to its outermost end. This embodiment has proven to be particularly beneficial for the forming of unobstructed circular flows, that is to say braided flows 44 (see, for example, FIG. 4) whilst avoiding secondary vortices within the grinding cells 34 which, in turn, is a prerequisite for an efficient operation at high grinding body filling degrees.

As can be seen in FIG. 4, dual circular flows, so-called braided flows 4, are formed within the individual grinding cells 34. In the region of the agitating disc 18 the grinding bodies 33 and the grinding material to be processed, the grinding suspension, flow outwards in the direction towards the inner wall 11 that bounds the grinding chamber 14 at the outside due to the tangential accelerations caused by the agitating discs 18, respectively, and then in the axially central area of the grinding cell 34 back inwards towards the agitating shaft 16. Radially outside the entraining profiles 35 shaped as groove-like channels 36, the agitating disc 18 practically acts as a double-sided deflection device. This peripheral portion 42 of the agitating disc 18, in which the agitating discs 18 have the same thickness as in the region of the spacer sleeve 19, ensures a fan-out and change of direction of the mixture of grinding bodies 33 and grinding material that is accelerated outwardly. The upstream side—relative to the overall-direction of flow 45 through the agitator ball mill—of the peripheral portion 42 of the respective agitating disc 18 redirects the mixture of grinding bodies and grinding material upstream. This impact on the grinding bodies 33 opposite to the overall-direction of flow 45 effects that these are not carried along to the next downstream grinding cell 34 by the grinding suspension flow speed, even at a higher degree of filling with grinding bodies and at typical grinding suspension flow speed. Accordingly, this results in a constant distribution of grinding bodies over the entire grinding chamber 14. The downstream side of the peripheral portion 42 of the agitating disc 18 bounding the grinding cell 34, however, effects a respective deflection in the downstream direction. The grinding suspension flows through the annulus of the gap 32 where only a reduced amount of grinding bodies is present due to the agitating disc 18 being embodied in accordance with the invention, and is sucked into the circular flow 44 in the grinding cell 34 located downstream. As can be seen in FIG. 4, the outer channel sections 41 can be provided with a guiding slope 46 at the transition to the peripheral portion 42 in order to support the respective deflections.

For the description of the embodiment according to FIGS. 5 to 7 the following applies: As far as the parts are identical, the same reference numbers are used, as far as the parts are comparable, the same reference numbers with a consecutive a are used without there being a necessity of a repeated detailed description. The agitating disc 18*a* according to FIGS. 5 and 6 and the agitating disc 18 according to FIGS. 2 and 3 differ in that the channels 36*a* are not embodied as grooves with a wall portion 37 separating them from each other, but instead are formed as continuous through-slots comprising a wall 39 extending from surface to surface of an agitating disc 18*a* as an entraining profile. The mechanism of action generally corresponds to the one of the embodiment according to FIGS. 2 to 4. The significantly increased surface of the wall 39 accelerating the grinding bodies 33 due to the omission of the wall portion 37 leads to a further increase of the efficiency of the agitator ball mill or allows for a constant output already at a decreased agitator speed. Of course, grinding material can directly pass from a grinding cell 34 to a downstream located adjacent grinding cell 34 through the channels 36*a* being embodied as continuous through-slots having the respective channel sections 40*a* and 41*a*. How much of this generally undesired effect occurs depends on the chosen operating parameters, especially on the volume throughput of grinding suspension per unit of time and the degree of filling with grinding bodies. It can be seen in FIG. 7—similar to FIG. 4—that the concentration of grinding bodies strongly decreases towards the agitating shaft 16 and strongly increases towards the wall 11.

Mixed embodiments of closed groove-like channels and channels embodied as continuous through-slots are possible, which may lead to further advantages in the sense of the teaching of the invention.

For the description of the example according to FIGS. 8 and 9, the following applies: As far as the parts are identical, the same reference numbers are used, as far as the parts are comparable, the same reference numbers with a consecutive b are used without there being a necessity of a repeated detailed description. In the agitating disc 18*b* according to FIGS. 8 and 9, the wall portion 37*b* separating two congruent channels 36*b* is broken through over approximately the length of the straight channel section 40*b* while the wall portion 37*b* in the radially outer groove-like channel section 41 that is bent off counter to the spinning direction 38 still exists. This embodiment has the advantage that, due to the missing of the separating wall, the entraining effect on the grinding bodies 33 is intensified in the region of the lower circumferential speed—i.e. precisely at the location where it is particularly required. In the peripheral portion with more grinding bodies in the region of the bent off channel section 41, the separating wall portion 37*b* prevents an uncontrolled passage of grinding suspension and grinding bodies 33 from one grinding cell 34 to and adjacent one. This measure helps in narrowing the particle size distribution and therefore increases the grinding quality or the grinding efficiency. Otherwise, the explanations as to the mechanism of action described above are also applicable here.

Also for the embodiment according to FIGS. 10 and 11 the following applies: As far as the parts are identical, the reference numbers from FIGS. 2 and 3 are used. As far as the parts are comparable, the reference numbers from FIGS. 2 and 3 with a consecutive c are used. Insofar, there is no necessity of a further detailed description. In the agitating disc 18 according to FIGS. 10 and 11, grinding material passage openings 47 are formed in the wall portion 37*c* of the groove-like channels 36*c* in the immediate proximity of the agitating shaft 16, and thus of the spacer sleeve 19, through which, due to the low concentration of grinding bodies 33 adjacent to the agitating shaft 16, essentially only grinding material can pass from one grinding cell 34 to an—in the overall-direction of flow 45—adjacent grinding cell 34. The ratio between the radial extension R47, i.e. the extension of the grinding material passage openings 47 from the grinding chamber inner boundary in the radial direction of the agitating disc 18*c*, and the radial extension R18 of the agitating discs 18*c* from the grinding chamber inner boundary, i.e. the spacer sleeves 19, to the outer edge 30 is: $0.05 \cdot R18 \leq R47 \leq 0.25 \cdot R18$. Preferably, the condition $R47 \leq 0.20 \cdot R18$ applies, and especially preferably $R47 \leq 0.15 \cdot R18$.

The grinding material through-openings 47 are arranged in the immediate proximity to the spacer sleeves 19 (grinding chamber inner boundary). The term "in the immediate proximity" means that either the radially inner boundary of the grinding material passage openings 47 is bounding to distance sleeve 19, or that the radially inner boundary of the grinding material passage openings is arranged at short radial distance from the spacer sleeve 19, so that in general this distance is either zero (bounding) or can be up to about one tenth of the radial extension R18 of the agitating discs 18*c* or 18*b* ($\leq 0.1 \cdot R18$).

Due to the very low resistance to pass through when compared to the conditions in the region of accumulated grinding bodies in the region adjacent to the outer edge 30 of the agitating discs 18*c*, this embodiment is also appropriate for top grinding body filling degrees and particularly high overall flow speeds while maintaining a uniform grinding body distribution along the grinding chamber 14. A high efficiency can already be achieved at reduced agitator speed. An uncontrolled passage of grinding suspension from one grinding cell 34 to an adjacent grinding cell 34 is completely eliminated because of the well-defined boundary of the grinding cells 34 from one another. Particularly high grinding qualities in terms of homogeneity result from this embodiment, what can be verified by the narrow particle size distribution of the processed grinding suspension. Other than that, the mechanism of action here, too, is as described above.

The invention claimed is:

1. An agitator ball mill comprising:

a horizontally arranged grinding vessel enclosing a cylindrical grinding chamber having a free radius R14, the grinding chamber being bounded by a grinding vessel wall and by a grinding chamber inner boundary, a grinding material feed leading into the grinding vessel at one end of the grinding vessel, a grinding material outlet leading out from the grinding vessel at the other end of the grinding vessel, and a separator for separating an amount of grinding material and a plurality of grinding bodies, the separator being arranged upstream of the grinding material outlet, an agitator arranged inside the cylindrical grinding chamber, the agitator comprising an agitating shaft having a central longitudinal axis and being rotatably drivable in a spinning direction, the agitator comprising agitating discs mounted to the agitating shaft and fixed against rotation relative thereto, the agitating discs being arranged at an axial distance from one another, the agitating discs have an outer edge, a thickness d, and a free radius R18 extending from the grinding chamber inner boundary to the outer edge of the agitating discs, wherein a gap is formed between the outer edge of the agitating discs and the grinding vessel wall, the gap having a radial width b, wherein a grinding cell is bounded by two of the agitating discs respectively, and wherein the agitating discs comprise a plurality of channels and entraining profiles formed in the agitating discs, for entraining the grinding bodies, each of the entraining profiles being formed by a trailing wall of a respective channel of the plurality of channels, with the trailing wall of the respective channel running parallel to the central longitudinal axis of the agitating shaft, and with the trailing wall of the respective channel being formed by a bent-off channel section being bent off relative to the central longitudinal axis of the agitating shaft in a direction counter to the spinning direction of the agitating shaft, wherein the respective channels comprise a straight inner channel section running radially relative to the central longitudinal axis of the agitating shaft and having a length f, wherein the respective channel further comprises an outer channel section comprising the bent off channel section, and wherein the outer channel section of the respective channel is radially closed to the outside by a peripheral portion of the agitating disc, the peripheral portion having a radial width e.

2. Agitator ball mill according to claim 1, wherein the channels are formed on both sides of the agitating discs, and wherein the channels formed on different ones of both sides of the agitating discs are pairwise congruently arranged.

3. Agitator ball mill according to claim 2, wherein the pairwise congruently arranged channels are grooves separated from each other by a wall portion of the agitating discs.

4. Agitator ball mill according to claim 3, wherein the wall portion of the agitating discs comprises a grinding material passage opening, in the straight inner channel section of the respective channel, the grinding material passage opening having a radial extension R47.

5. Agitator ball mill according to claim 2, wherein the pairwise congruently arranged channels are connected in the manner of a slot.

6. Agitator ball mill according to claim 1, wherein at a transition of the outer channel section of the respective channel to the peripheral portion of the agitating discs the respective channel is provided with a guiding slope for redirecting the grinding bodies to the grinding cell that is faced by the respective channel.

7. Agitator ball mill according to claim 1, wherein the ratio of the radial width b of the gap and the free radius R14 of the grinding chamber is: $b \leq 0.2 \cdot R14$.

8. Agitator ball mill according to claim 1, wherein the ratio of the thickness d of the agitating discs and the radial width e of the peripheral portion of the agitating discs is: $0.5 \cdot d \leq e \leq 1.5 \cdot d$.

9. Agitator ball mill according to claim 1, wherein the ratio of the free radius R18 of the agitating discs and the length f of the straight inner channel section is: $0.25 \cdot R18 \leq f \leq 0.6 \cdot R18$.

10. Agitator ball mill according to claim 1, wherein the outer channel section of the respective channel merges into the peripheral portion of the agitating discs with a radius r41/42, wherein the radius r41/42 in relation to a width c of the respective channel is: $r41/42 \leq 0.2 \cdot c$.

11. Agitator ball mill according to claim 4, wherein the grinding material passage openings are only arranged in immediate proximity to the inner boundary of the grinding chamber.

12. Agitator ball mill according to claim 4, wherein the ratio of the radial extension R47 of the grinding material passage opening and the radial extension R18 of the agitating discs, each being counted from the grinding chamber inner boundary, is: $0.05 \cdot R18 \leq R47 \leq 0.25 \cdot R18$.

13. The agitator ball mill according to claim 1, wherein the agitating discs comprise an outer edge, a thickness d, a plurality of entraining profiles formed in the agitating disc, for entraining a plurality of grinding bodies, each of the entraining profiles being formed by a trailing wall of a respective channel, with the trailing wall of a respective channel running parallel to a central longitudinal axis, and with the trailing wall of the respective channel being formed by a bent-off channel section which is bent off relative to the central longitudinal axis in a direction counter to a spinning direction of the agitating discs, wherein the respective channel comprises a straight inner channel section having a length f and running radially relative to the central longitudinal axis of the agitating shaft, wherein the respective channel further comprises an outer channel section comprising the bent off channel section, and wherein the outer channel section is radially closed to the outside by a peripheral portion of the agitating disc.

14. The agitator ball mill according to claim 13, wherein the channels are formed on both sides of the agitating discs, and wherein the channels formed on different ones of the both sides of the agitating disc are pairwise congruently arranged.

15. The agitator ball mill according to claim 13, wherein at a transition of the outer channel section of the respective channel to the peripheral portion of the agitating discs the respective channel is provided with guiding slopes.

* * * * *